US006289950B1

(12) United States Patent
Chiang

(10) Patent No.: US 6,289,950 B1
(45) Date of Patent: Sep. 18, 2001

(54) WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 09/740,909

(22) Filed: Dec. 19, 2000

(51) Int. Cl.[7] ..... B27C 1/00

(52) U.S. Cl. ..... 144/117.1; 144/130; 144/242.1; 144/246.1; 144/373; 198/780; 226/193

(58) Field of Search ..... 198/780, 957; 226/190, 193; 144/114.1, 117.1, 129, 130, 242.1, 246.1, 373

(56) References Cited

U.S. PATENT DOCUMENTS 3,718,168 * 2/1973 Berends ..... 144/129

6,089,287 * 7/2000 Welsh et al. ..... 144/117.1 X

* cited by examiner

*Primary Examiner*—W. Donald Bray
(74) *Attorney, Agent, or Firm*—Ladas And Parry

(57) ABSTRACT

A wood planing machine includes a base, two pairs of supporting rods respectively extending upright from the base, a cutter carriage including a pair of parallel carriage seats mounted movably and respectively on the pairs of the supporting rods, an emery axle mounted rotatably on the carriage seats and movable upward and downward relative to the carriage seats, and an axle height adjusting unit including a lever mounted on the carriage seats above the emery axle, and a pair of linkage plates interconnecting the lever and the emery axle. The lever is an eccentric rod, and is turnable about a horizontal axis so as to move the emery axle upward and downward.

4 Claims, 11 Drawing Sheets

WOOD PLANING MACHINE

BACKGROUND OF THE INVENTION

1. Field of the Invention

This invention relates to a wood planing machine, more particularly to a wood planing machine having an, emery axle for grinding a wooden workpiece.

2. Description of the Related Art

Wood planing normally involves a grinding operation after planing. Conventionally, a wooden workpiece is planed on a wood planing machine, and is subsequently transferred to a grinding machine for grinding. The aforesaid transfer of the workpiece is inconvenient to conduct. Moreover, it is relative expensive to install a separate grinding machine.

SUMMARY OF THE INVENTION

Therefore, it is an object of the present invention to provide a wood planing machine that is capable of providing both planing and grinding functions for a wooden workpiece.

Accordingly, a wood planing machine of this invention comprises: a base having two opposite sides; two pairs of supporting rods respectively extending upright from the opposite sides of the base; a cutter carriage including a pair of opposite parallel carriage seats mounted movably and respectively on the pairs of the supporting rods, each of the carriage seats including top and bottom plates spanning the respective one of the pairs of the supporting rods, and a side plate interconnecting the top and bottom plates and extending between the respective one of the pairs of the supporting rods, the side plates of the carriage seats respectively having slots formed therein and horizontally aligned; a rotary cutter disposed between and mounted rotatably on the side plates of the carriage seats; an emery axle spanning and mounted rotatably on the side plates of the carriage seats, and having two opposite ends respectively extending through the slots, the emery axle being movable upwardly to an upper position and downwardly to a lower position; two bearing units, each of which includes a bearing housing that is mounted slidably on a periphery of one of the slots, and a bearing that is disposed in the bearing housing and that is sleeved on one of the opposite ends of the emery axle; and an axle height adjusting unit including a lever mounted rotatably on the top plates of the carriage seats and aligned with the emery axle, and a pair of linkage plates respectively interconnecting the lever and the bearing housing of one of the bearing units and the lever and the bearing housing of the other one of the bearing units, the lever being turnable about a horizontal axis so as to move the emery axle to a selected one of the upper and lower positions.

BRIEF DESCRIPTION OF THE DRAWINGS

In drawings which illustrate an embodiment of the invention.

DETAILED DESCRIPTION OF THE PREFERRED EMBODIMENT

Figure 1:
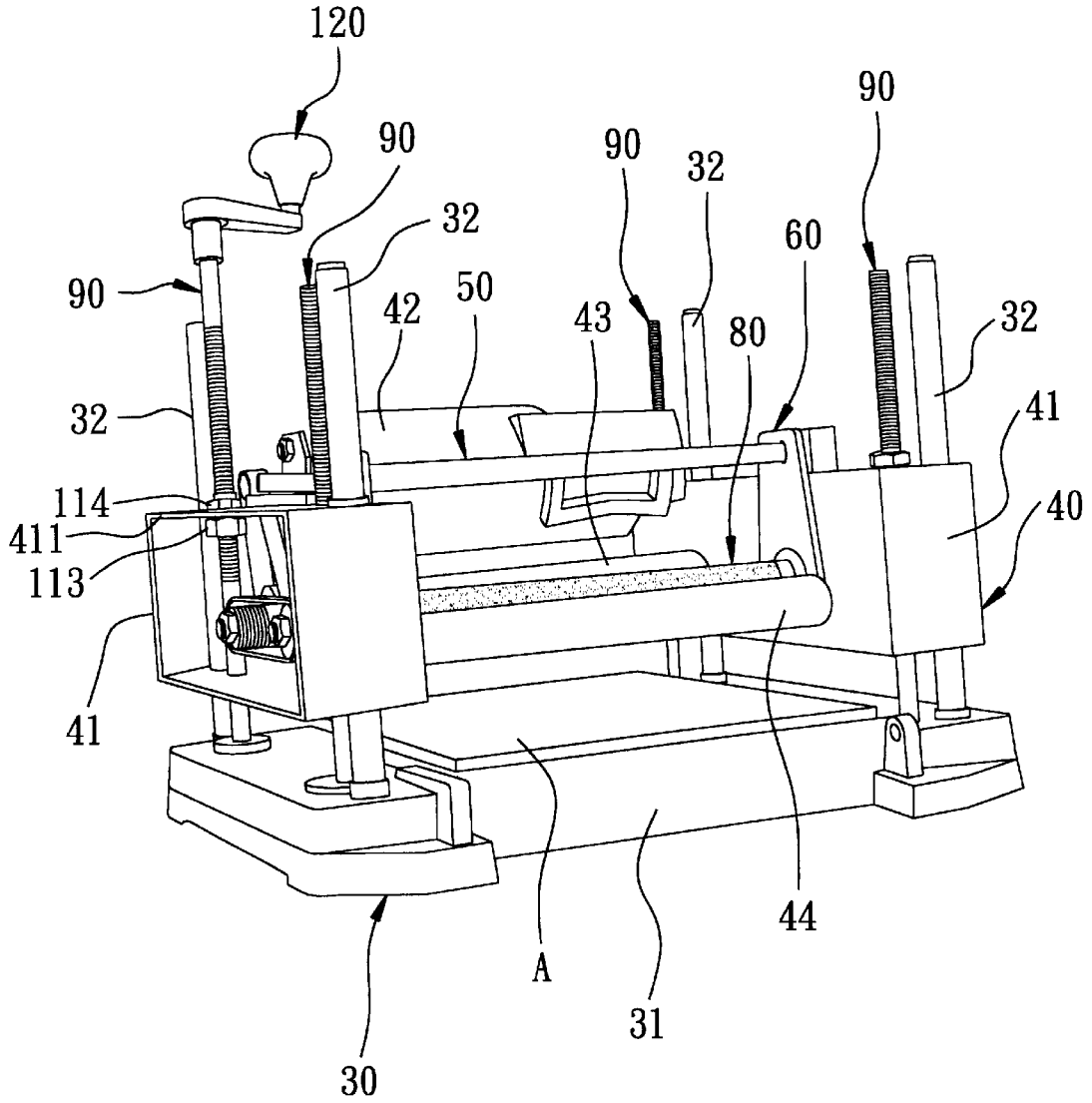
FIG. 1 is a perspective view of a wood planing machine embodying this invention.
Figure 2:
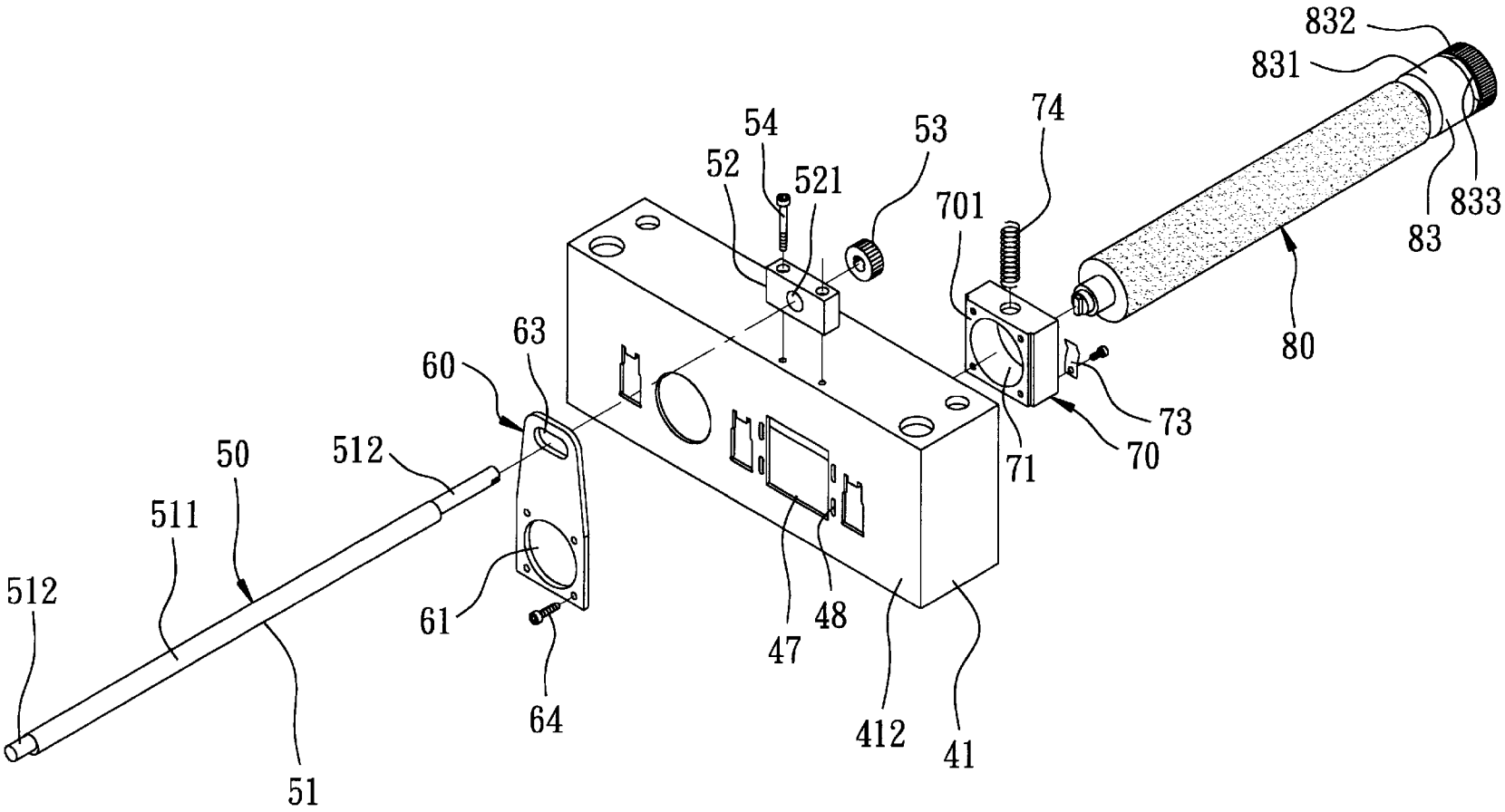
FIG. 2 is a fragmentary exploded view of the wood planing machine of FIG. 1, viewed from one side.
Figure 3:
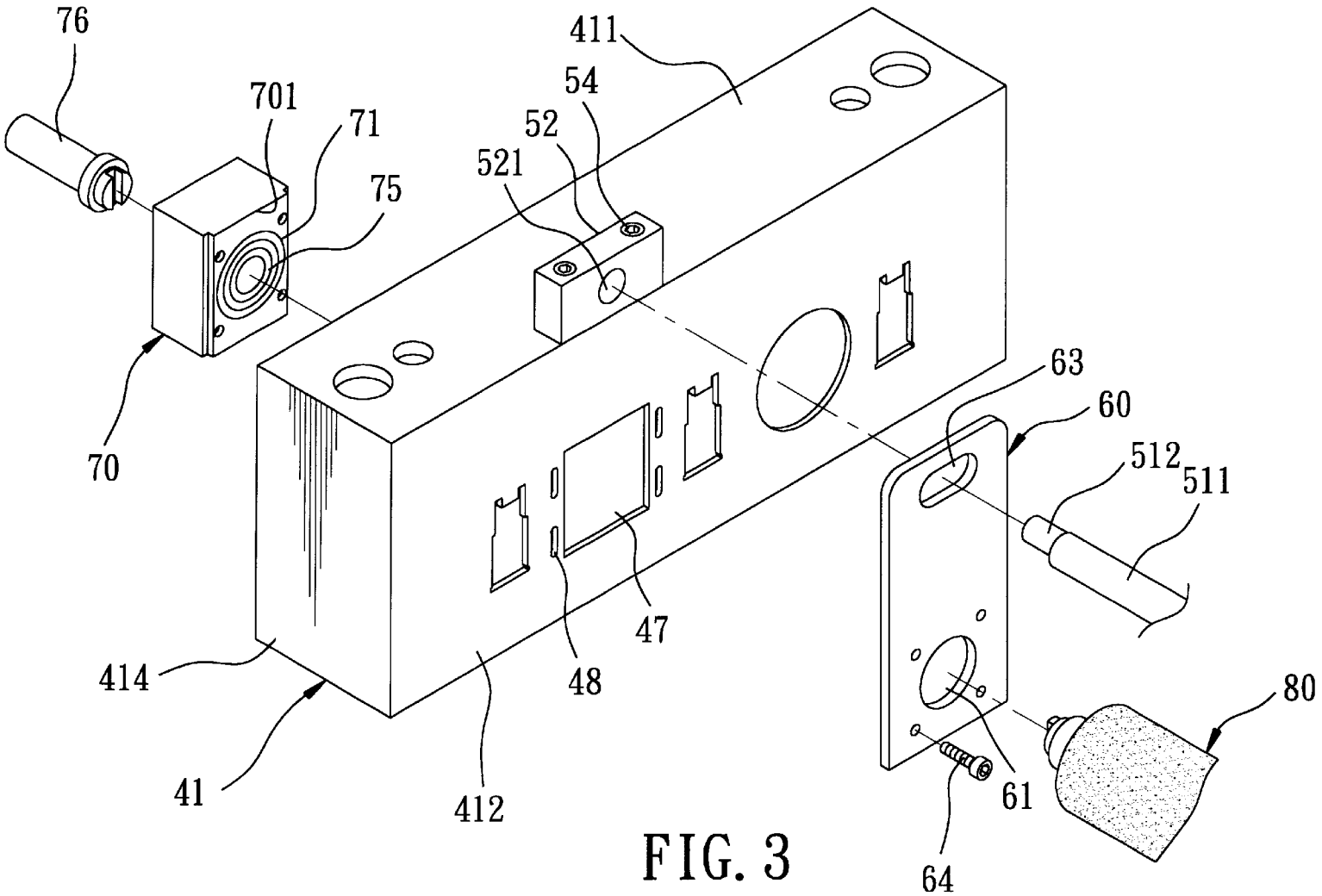
FIG. 3 is a fragmentary exploded view of the wood planing machine of FIG. 1, viewed from another side.
Figure 4:
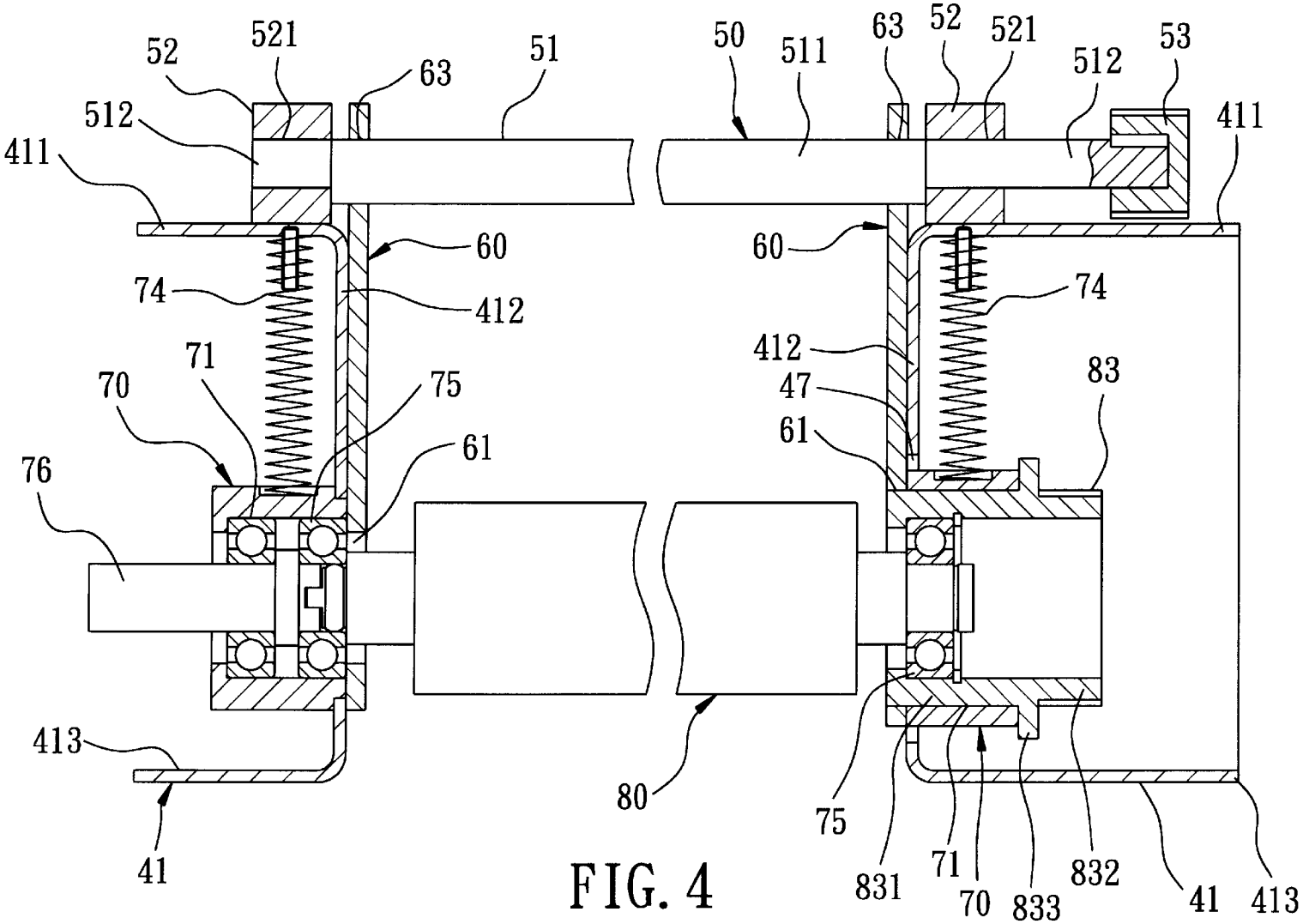
FIG. 4 is a fragmentary cross-sectional side view of the wood planing machine of FIG. 1.

FIGS. 1 to 4 illustrate a wood planing machine embodying this invention. The wood planing machine includes: a base 30 having two opposite sides and a worktable 31; two pairs of parallel posts 32 respectively extending upright from the opposite sides of the base 30; two pairs of parallel supporting rods 90, each of which is formed as a screw rod, the supporting rods 90 respectively extending upright from the opposite sides of the base 30, being parallel to and offset from the posts 32, and being rotatable about vertical axes defined by the screw rods 90; a cutter carriage 40 having a pair of parallel carriage seats 41 mounted movably and respectively on the pairs of the screw rods 90 above the worktable 31, each of the carriage seats 41 including top and bottom plates 411, 413 transverse to and spanning a respective one of the pairs of the screw rods 90, and a side plate 412 interconnecting the top and bottom plates 411, 413, and extending between the respective one of the pairs of the supporting rods 90, the side plates 412 of the carriage seats 41 respectively having slots 47 formed therein and horizontally aligned; a rotary cutter 43 disposed between and mounted rotatably on the side plates 412 of the carriage seats 41 for planing a wooden workpiece (A) on the worktable 31; a motor 42 mounted on the cutter carriage 40 between the carriage seats 41 for driving the rotary cutter 43; an emery axle 80 spanning and mounted rotatably on the side plates 412 of the carriage seats 41, and having two opposite ends respectively extending through the slots 47 in the side plates 412; two bearing units, each of which includes a bearing housing 70 that is mounted slidably on a periphery of one of the slots 47, and an axle bearing 75 that is disposed in the bearing housing 70 and that is sleeved on one of the opposite ends of the emery axle 80; a transmission rod 76 extending into the axle bearing 75 of one of the bearing units to connect with one of the opposite ends of the emery axle 80 so as to drive the emery axle 80 to rotate; and an axle height adjusting unit including a lever 50 disposed above the emery axle 80 and mounted rotatably on the top plates 411 of the carriage seats 41, and a pair of linkage plates 60 respectively interconnecting the lever 50 and the bearing housing 70 of one of the bearing units and the lever 50 and the bearing housing 70 of the other one of the bearing units.

Figure 7:
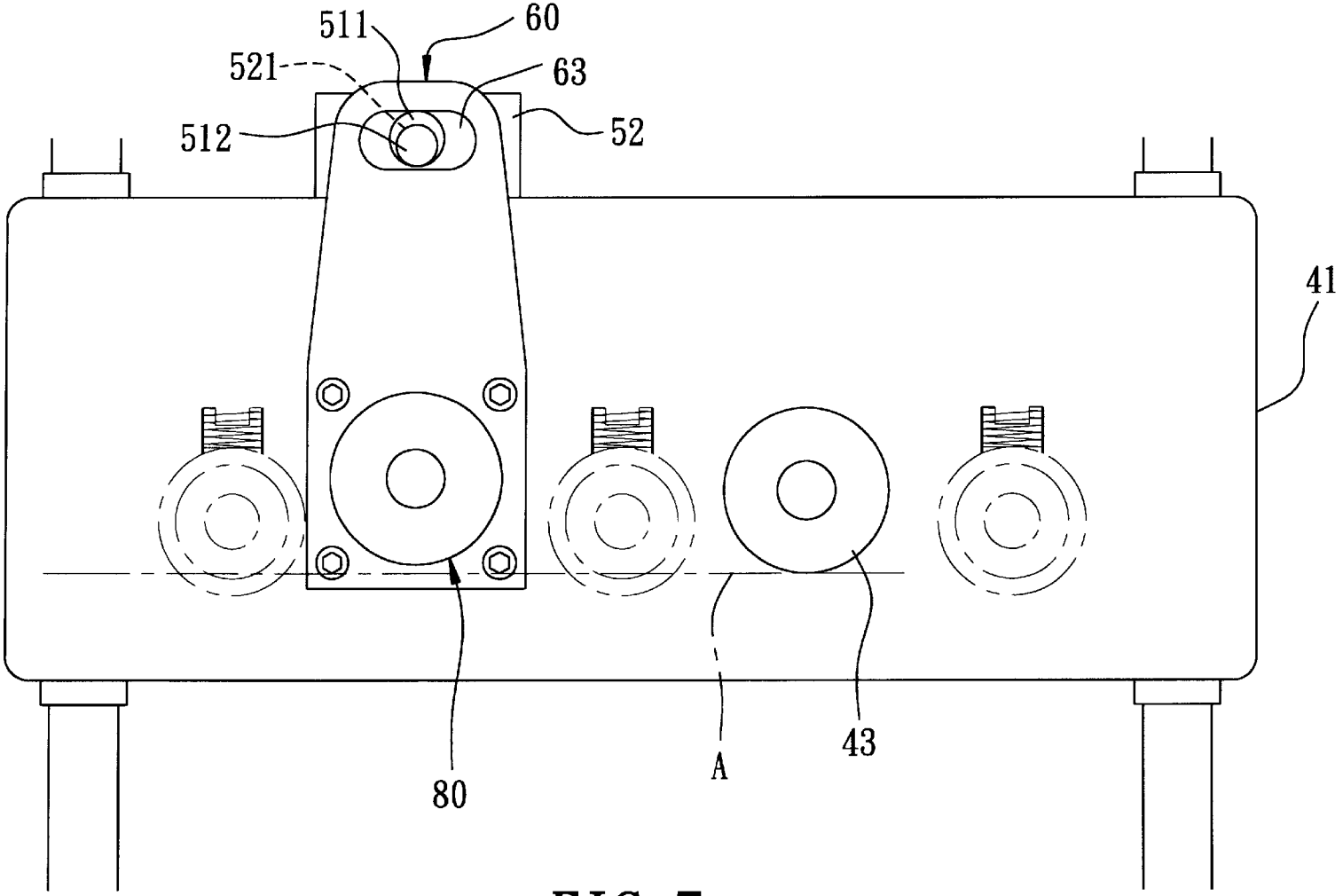
FIG. 7 is a fragmentary side view of the wood planing machine of FIG. 1, with an emery axle at an upper position.
Figure 8:
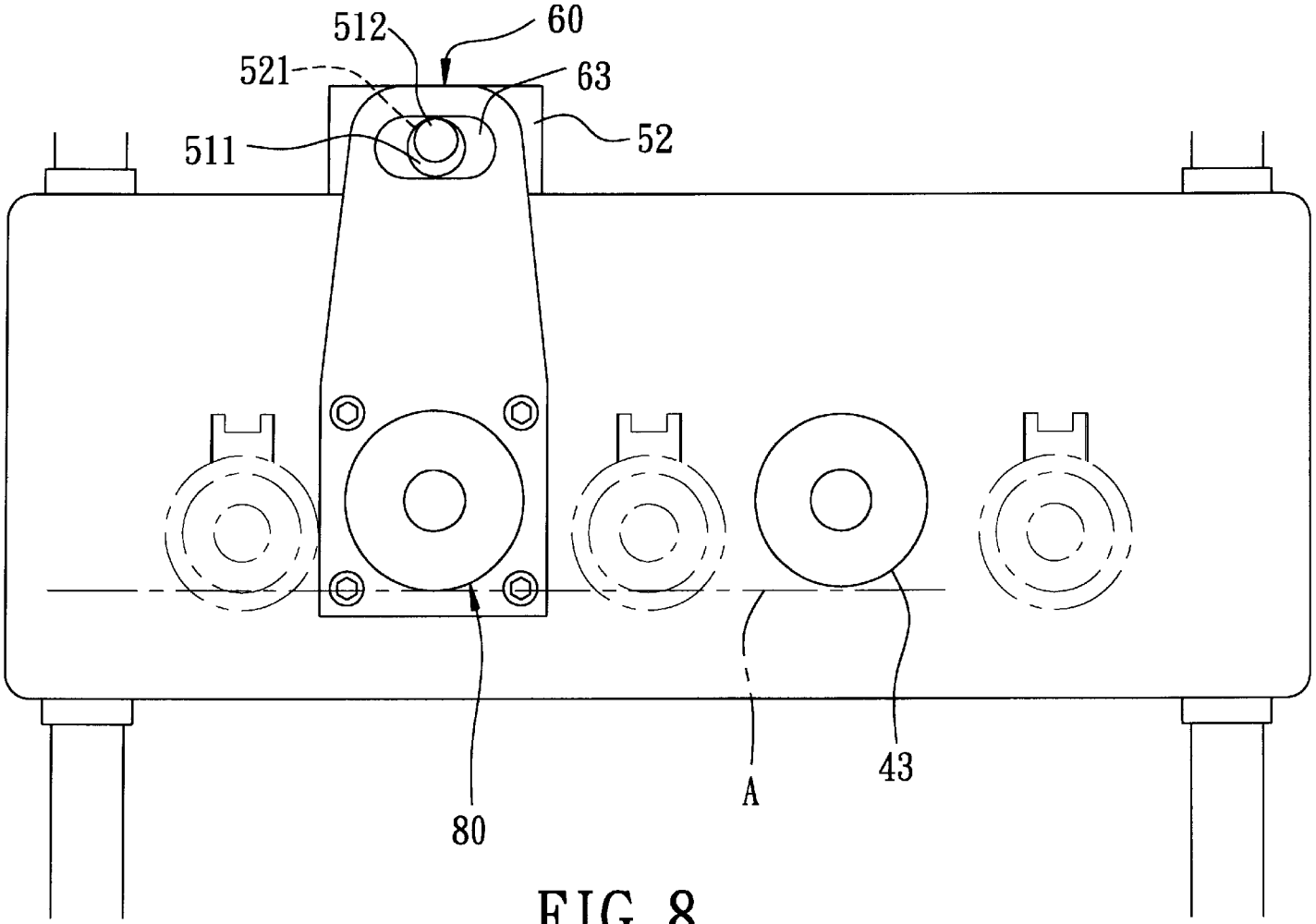
FIG. 8 is a fragmentary side view of the wood planing machine of FIG. 1, with an emery axle at a lower position.

A pair of supporting blocks 52 are respectively mounted on the top plates 411 of the carriage seats 41 via screw means 54, and respectively have through-holes 521 formed therein. The lever 50 is an eccentric rod 51, and includes an intermediate section 511 and two opposite end sections 512 extending oppositely from the intermediate section 511 to be received fittingly and rotatably in the through-holes 521. The intermediate section 511 is eccentric relative to the end sections 512, and has a cross-section greater than that of each end section 512. The lever 50 is turnable about a horizontal axis, which extends through centers of the end sections 512. The intermediate section 511 turns eccentrically relative to the horizontal axis so as move the emery axle 80 between an upper position (see FIG. 7), in which the emery axle 80 is at a level above the workpiece (A) on the worktable 31, and a lower position (see FIG. 8), in which the emery axle 80 is at a level that is sufficient to establish contact with the workpiece (A) on the worktable 31. A knob 53 is connected to one of the end sections 512 for turning the lever 50.

Two pairs of elongated openings 48 are formed in the side plate 412 of each carriage seat 41 adjacent to the respective slot 47. Each linkage plate 60 and the associated one of the bearing housings 70 are mounted movably on two opposite sides of the respective side plate 412 via screw means 64 extending through the linkage plate 60 and the bearing housing 70 and the openings 48 so as to permit the emery axle 80 to be movable upwardly and downwardly along lengths of the openings 48.

Each linkage plate 60 has a top end formed with a top hole 63 that receives one end of the intermediate section 511, and a bottom end formed with a bottom hole 61 that is aligned with the respective slot 47 for passage of the respective end of the emery axle 80.

Figure 5:
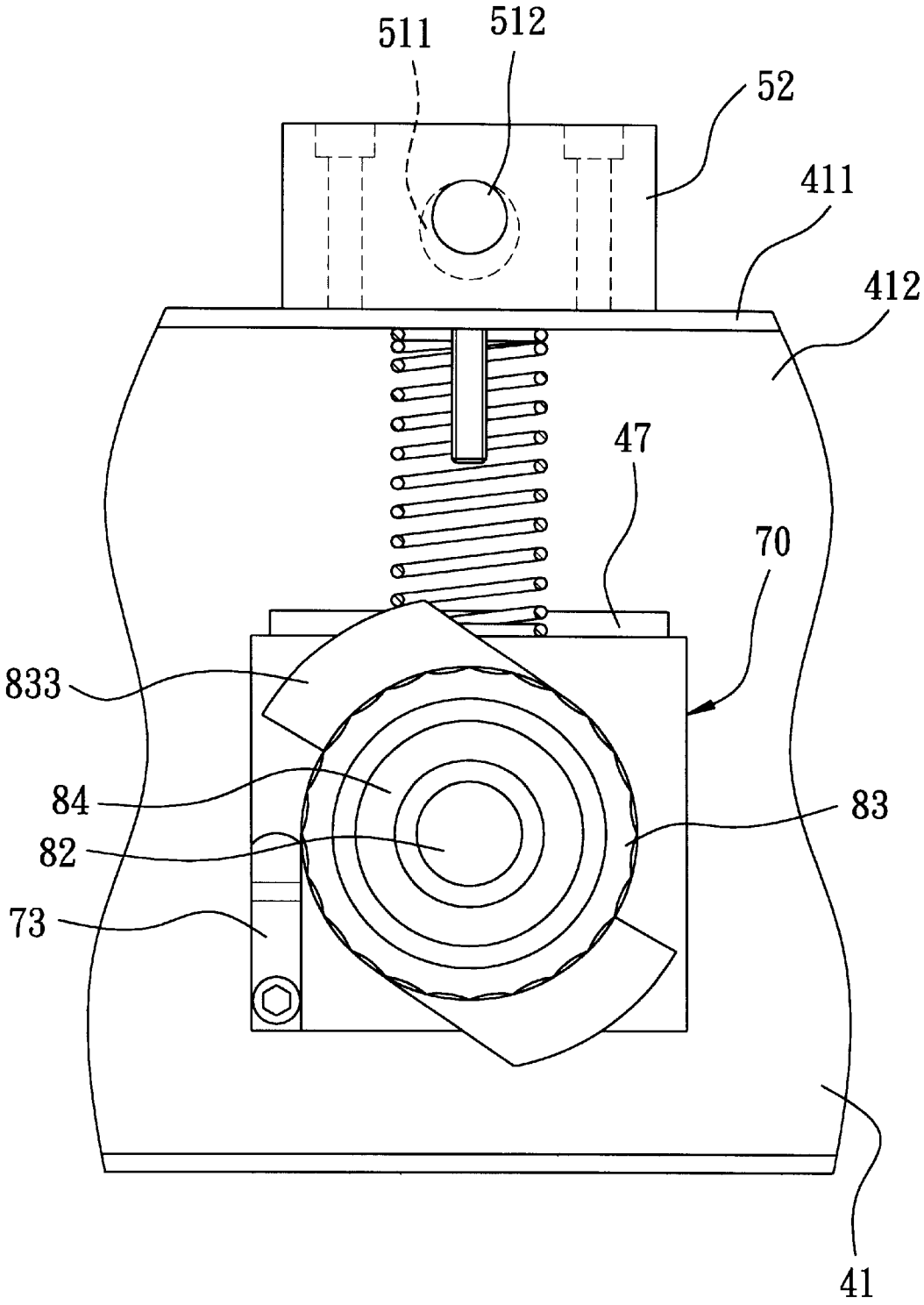
FIG. 5 is a fragmentary side view of the wood planing machine of FIG. 1, with a stop plate at a releasing position.
Figure 6:
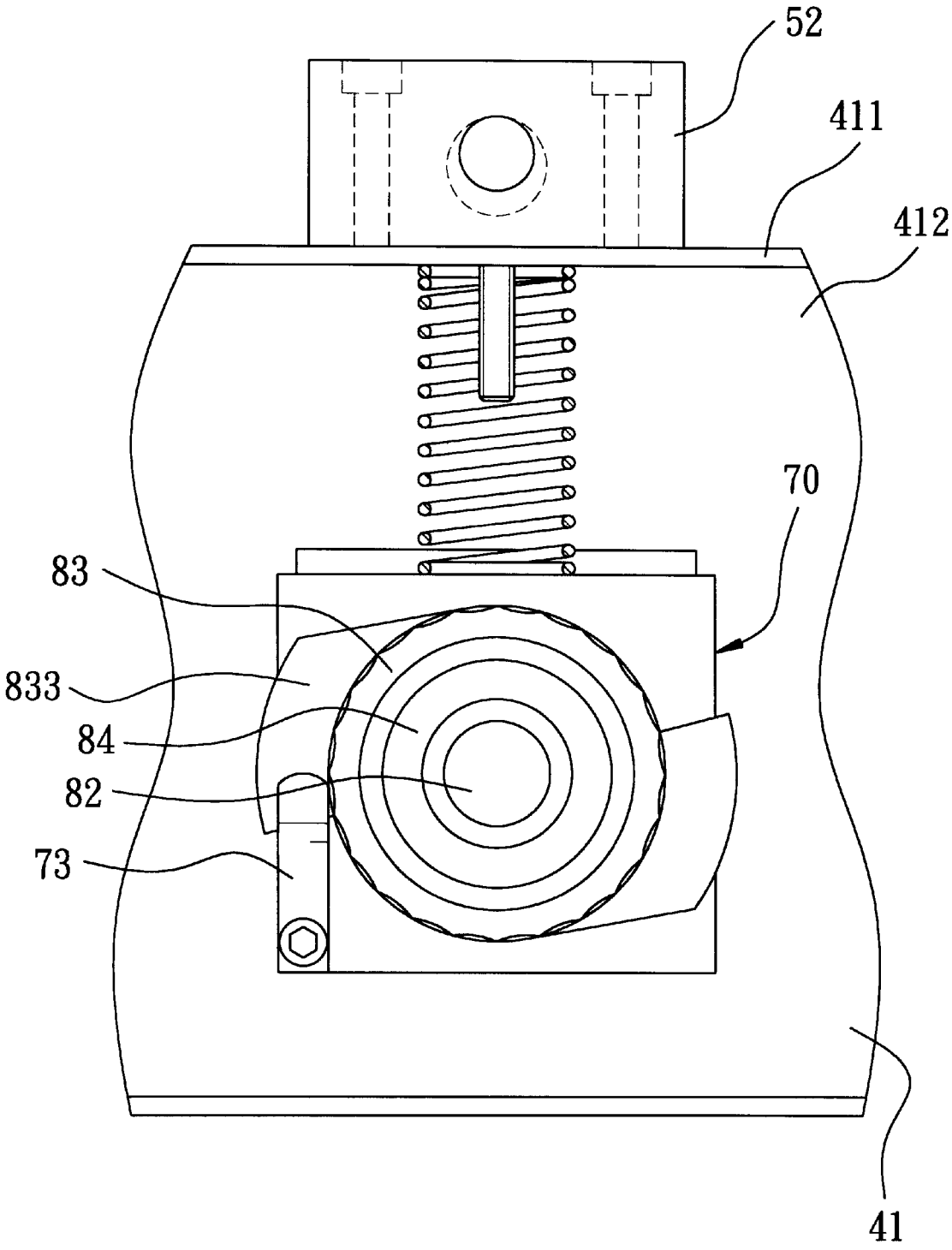
FIG. 6 is a fragmentary side view of the wood planing machine of FIG. 1, with the stop plate at a locking position.

Each bearing housing 70 has a reduced end 701 received fittingly and slidably in the respective slot 47, and is formed with a through-hole 71 that is aligned with the respective slot 47. The axle bearing 75 of one of the bearing units is received fittingly and securely in the respective bearing housing 70 that is associated with the transmission rod 76. The axle bearing 75 of the other bearing unit is received fittingly and securely in a hollow knob 83, which has one end 831 received fittingly and rotatably in the associated bearing housing 70, and the other end 832 extending through the associated bearing housing 70. A stopper 73 is secured to an end face of the bearing housing 70 that is associated with the knob 83. A pair of opposite wing plates 833 project outwardly from the other end 832 of the knob 83. The knob 83 is turnable to a locking position (see FIG. 6), in which one of the wing plates 833 engages the stopper 73 so as to lock the emery axle 80 against axial movement when the emery axle 80 rotates, and a releasing position (see FIG. 5), in which the associated wing plate 833 disengages from the stopper 73. A pair of coil springs 74 are respectively disposed between and abut against the top plates 411 of the carriage seats 41 and top ends of the bearing housings 70.

With the emery axle 80 installed in the wood planing machine of this invention, the inconvenience and expensive cost drawbacks as encountered in the prior art can be eliminated.

Figure 9:
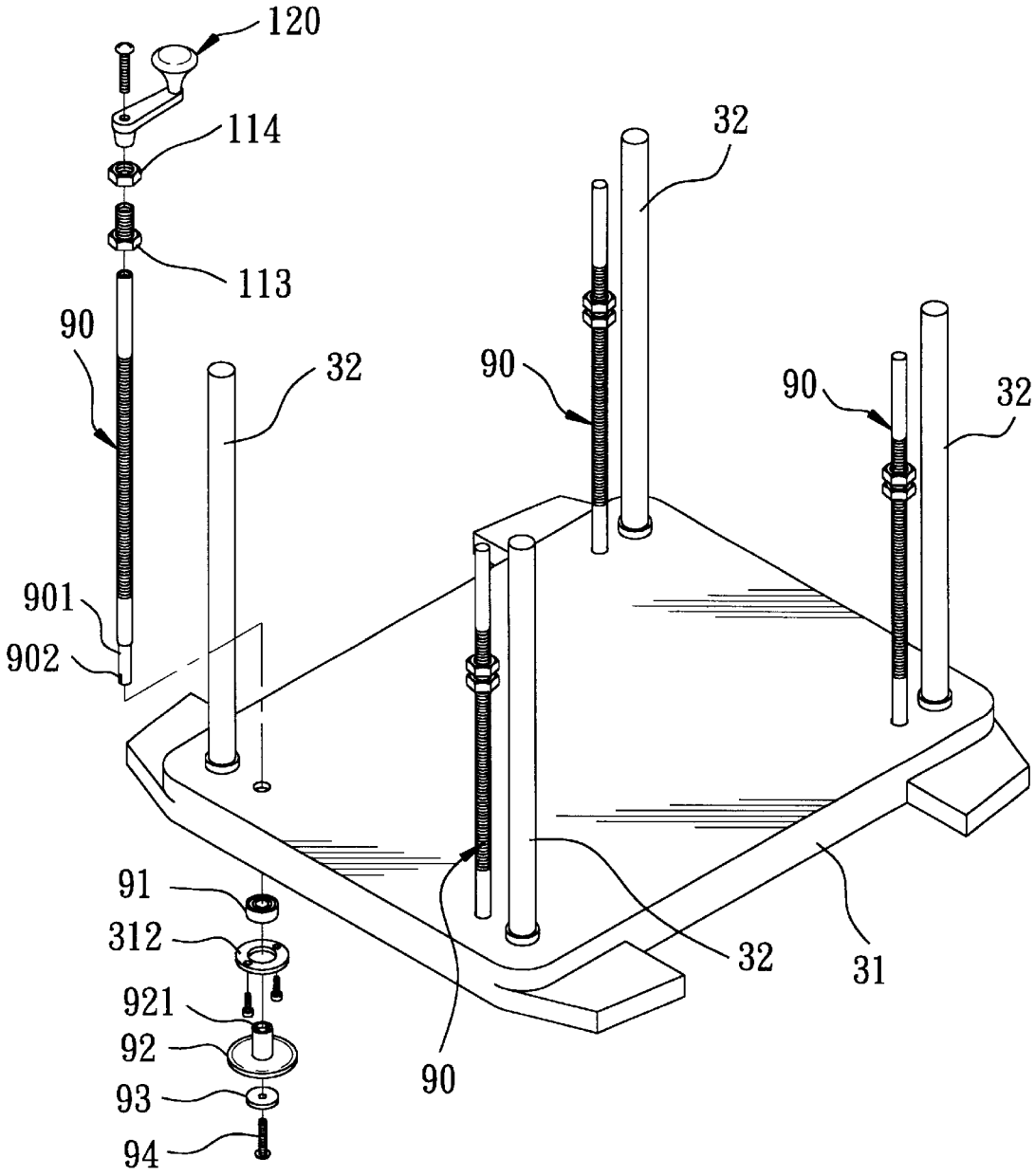
FIG. 9 is a partly exploded view of a carriage height adjusting unit of the wood planing machine of FIG. 1.
Figure 10:
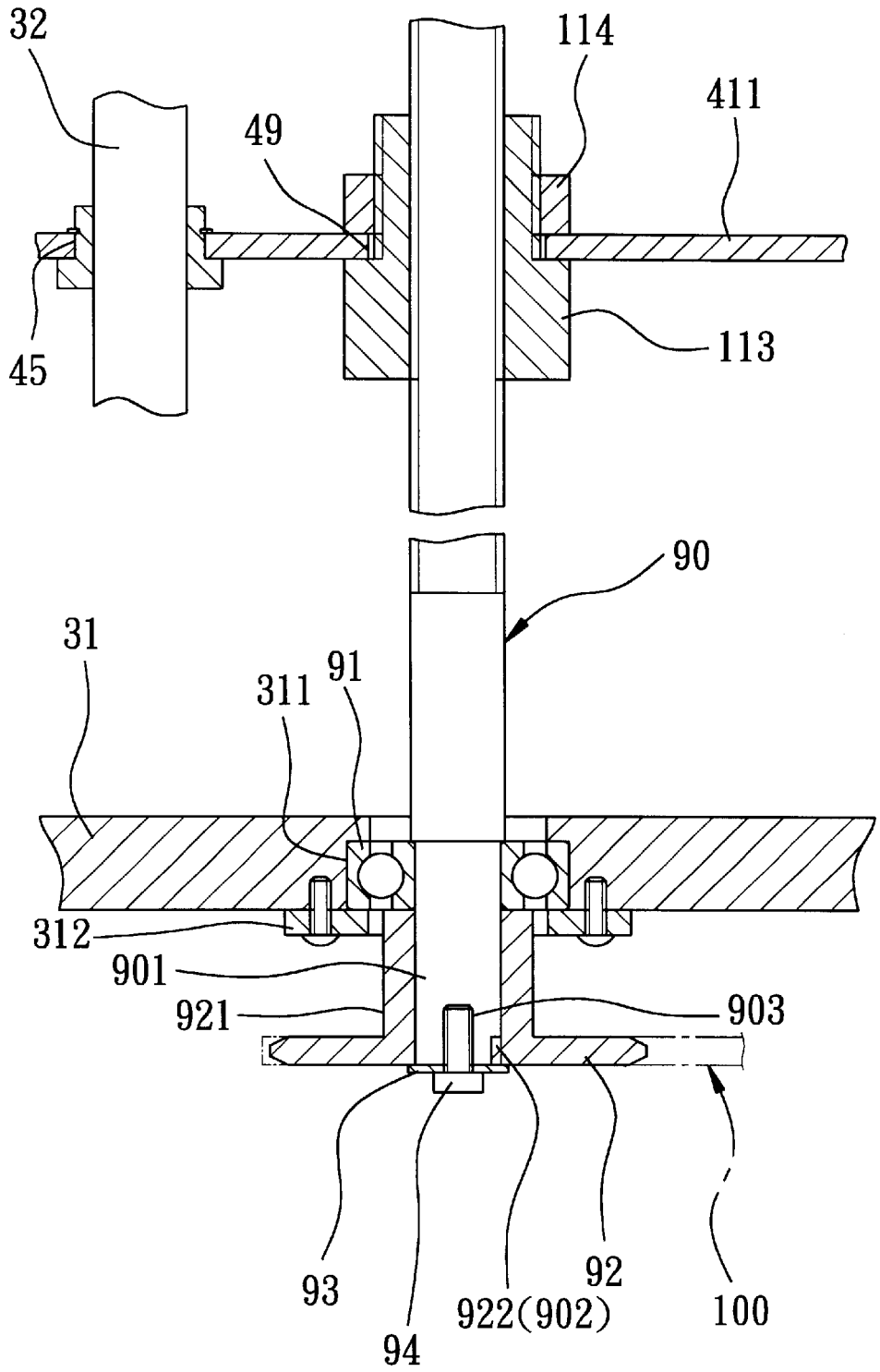
FIG. 10 is a partly cross-sectional side view of the carriage height adjusting unit of the wood planing machine of FIG. 1.
Figure 11:
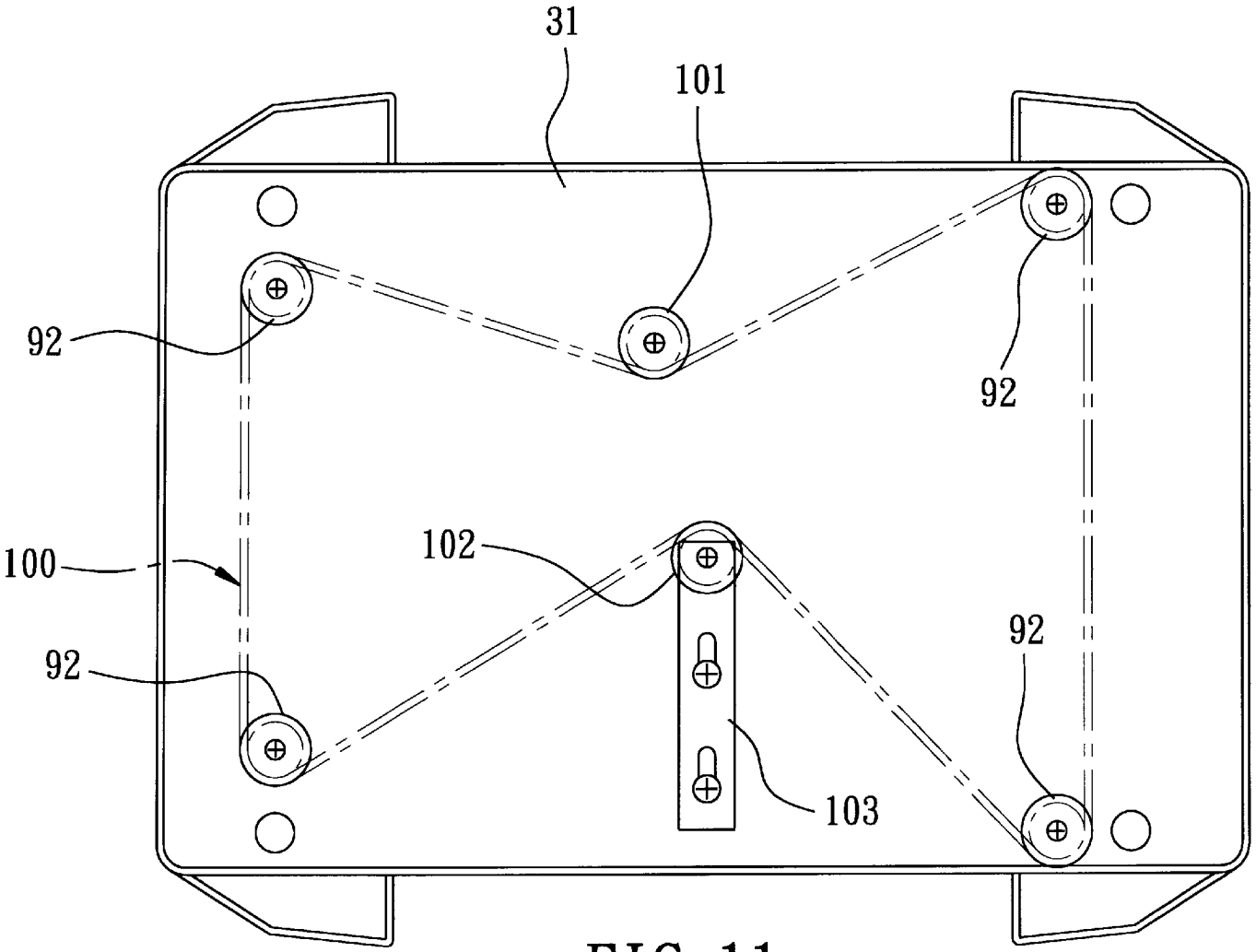
FIG. 11 is a bottom view of the wood planing machine of FIG. 1.

Referring to FIGS. 9 to 11, in combination with FIG. 1, the wood planing machine further includes two pairs of carriage bearings 91 secured to the base 30 via positioners 312 and respectively sleeved on the screw rods 90; four sprockets 92 disposed underneath the base 30 and connected respectively to bottom ends 901 of the screw rods 90; a chain 100 engaging the sprockets 92 so as to synchronize rotations of the screw rods 90; a handle 120 connected to a top end of one of the screw rods 90 to actuate rotation of the screw rods 90; two pairs of sleeves 45 respectively secured to the top plates 411 of the carriage seats 41 and respectively sleeved on the posts 32; and four cylindrical hollow threaded members 113 secured to the top plates 411 of the carriage seats 41 via nuts 114.

The screw rods 90 respectively extend through and threadedly engage the threaded members 113 so as to permit the carriage seats 41 to be moved simultaneously along the screw rods 90 when the screw rods 90 rotate synchronously, and to be held firmly at a desired height relative to the worktable 31 on the base 30 by engagement of the screw rods 90 and the threaded members 113 upon stopping rotation of the screw rods 90.

Each sprocket 92 includes a sleeve portion 921 sleeved on and secured to a bottom end 901 of the respective screw rod 90 via a positioner 93 and screw means 94. A groove 902 is formed in the bottom end 901 of each screw rod 90. The sleeve portion 921 of each sprocket 92 has an inner tongue 922 projecting into and engaging the groove 902 in the bottom end 901 of the respective screw rod 90 so that each sprocket 92 is rotatable with the respective screw rod 90.

Two spaced apart non-adjustable and adjustable sprockets 101, 102 are disposed between the pairs of the sprockets 92, and engage the chain 100 for adjusting tension of the latter so as to permit smooth transmission among the screw rods 90 and the sprockets 92. The adjustable sprocket 102 is mounted on a plate 103 which, in turn, is mounted adjustably on a bottom side of the worktable 31 of the base 30.

With four of the screw rods 90, the cutter carriage 40 can be held firmly at a desired height relative to the worktable 31 of the base 30 by engagement of the screw rods 90 and the threaded members 113 upon stopping rotation of the screw rods 90.

With the invention thus explained, it is apparent that various modifications can be made without departing from the spirit of the present invention. It is therefore intended that the invention be limited only as recited in the appended claims.

I claim:

1. A wood planing machine comprising:

a base having two opposite sides;

two pairs of supporting rods respectively extending upright from said opposite sides of said base;

a cutter carriage including a pair of opposite parallel carriage seats mounted movably and respectively on said pairs of said supporting rods, each of said carriage seats including top and bottom plates spanning the respective one of said pairs of said supporting rods, and a side plate interconnecting said top and bottom plates and extending between the respective one of said pairs of said supporting rods, said side plates of said carriage seats respectively having slots formed therein and horizontally aligned;

a rotary cutter disposed between and mounted rotatably on said side plates of said carriage seats;

an emery axle spanning and mounted rotatably on said side plates of said carriage seats, and having two opposite ends respectively extending through said slots, said emery axle being movable upwardly to an upper position and downwardly to a lower position;

two bearing units, each of which includes a bearing housing that is mounted slidably on a periphery of one of said slots, and a bearing that is disposed in said bearing housing and that is sleeved on one of said opposite ends of said emery axle; and an axle height adjusting unit including a lever mounted rotatably on said top plates of said carriage seats and aligned with said emery axle, and a pair of linkage plates respectively interconnecting said lever and said bearing housing of one of said bearing units and said lever and said bearing housing of the other one of said bearing units, said lever being turnable about a horizontal axis so as to move said emery axle to a selected one of said upper and lower positions.

2. The wood planing machine of claim 1, wherein said lever is an eccentric rod, and includes an intermediate section and two opposite end sections extending oppositely from said intermediate section, said horizontal axis extending through centers of said end sections, said intermediate section being eccentric relative to said end sections, said linkage plates being connected to said intermediate section.

3. The wood planing machine of claim 2, further comprising a transmission rod extending into said bearing of one of said bearing units to connect with the respective one of said opposite ends of said emery axle so as to drive said emery axle to rotate.

4. The wood planing machine of claim 1, wherein each of said supporting rods is a screw rod, and is rotatable about a vertical axis defined by said screw rod, said wood planing machine further comprising:

four sprockets disposed underneath said base and connected respectively to bottoms of said screw rods;

a chain engaging said sprockets so as to synchronize rotations of said screw rods; and four cylindrical hollow threaded members secured to said top plates of said carriage seats, said screw rods respectively extending through and engaging threadedly said threaded members so as to permit said carriage seats to be moved simultaneously along said screw rods when said screw rods rotate synchronously, and to be held firmly at a desired height relative to said base by engagement of said screw rods and said threaded members upon stopping rotation of said screw rods.

* * * * *